US011779951B2

(12) United States Patent
Madanoglu

(10) Patent No.: US 11,779,951 B2
(45) Date of Patent: Oct. 10, 2023

(54) EDGE-COATING A PANEL WITH A COATING MEDIUM

(71) Applicant: AKZENTA PANEELE + PROFILE GMBH, Kaisersesch (DE)

(72) Inventor: Yavuz Madanoglu, Mayen (DE)

(73) Assignee: Akzenta Paneele + Profile GMBH, Kaisersesch (DE)

( * ) Notice: Subject to any disclaimer, the term of this patent is extended or adjusted under 35 U.S.C. 154(b) by 0 days.

(21) Appl. No.: 17/913,243

(22) PCT Filed: Mar. 24, 2021

(86) PCT No.: PCT/EP2021/057577
§ 371 (c)(1),
(2) Date: Sep. 21, 2022

(87) PCT Pub. No.: WO2021/191280
PCT Pub. Date: Sep. 30, 2021

(65) Prior Publication Data

US 2023/0166286 A1 Jun. 1, 2023

(30) Foreign Application Priority Data

Mar. 24, 2020 (EP) ..... 20165261

(51) Int. Cl.
*B05C 5/02* (2006.01)
*B05C 11/10* (2006.01)

(52) U.S. Cl.
CPC ..... *B05C 5/0204* (2013.01); *B05C 11/1039* (2013.01)

(58) Field of Classification Search
None
See application file for complete search history.

(56) References Cited

U.S. PATENT DOCUMENTS 3,973,961 A * 8/1976 Stroszynski ..... G03G 5/0525 118/410
4,102,299 A * 7/1978 Wallsten ..... D21H 25/08 118/411
5,453,302 A * 9/1995 Chaudhry ..... B05D 7/146 118/421

(Continued)

FOREIGN PATENT DOCUMENTS

DE 4021174 A1 1/1992

OTHER PUBLICATIONS

EP Search Report and Written Opinion (German) issued in European Patent Application No. EP 20165261.7, dated Sep. 28, 2020.

*Primary Examiner* — Jethro M. Pence
(74) *Attorney, Agent, or Firm* — Harness, Dickey & Pierce, P.L.C.

(57) ABSTRACT

The disclosure relates to a coating device for edge-coating a panel with a coating medium, the device comprising at least one medium line, for guiding a coating medium, which comprises an inlet and an outlet, wherein the medium line comprises a recess for introducing a panel into a coating-medium stream, and wherein the medium line and the recess are designed such that the coating medium can be applied to the edge of the panel by means of suction in the flow direction of the medium. The present disclosure also relates to a coating system for edge-coating a panel with a coating medium.

14 Claims, 4 Drawing Sheets

(56) References Cited

U.S. PATENT DOCUMENTS

| | | | | |
|---|---|---|---|---|
| 5,614,265 | A * | 3/1997 | Chaudhry | B05C 3/12 118/421 |
| 6,759,091 | B2 * | 7/2004 | Mandai | B05C 5/0258 118/410 |
| 6,833,157 | B2 * | 12/2004 | Mandai | G03C 1/74 118/62 |
| 7,018,474 | B2 * | 3/2006 | Mandai | B05C 11/1013 118/410 |
| 7,025,830 | B2 * | 4/2006 | Kanke | G03C 1/74 118/680 |
| 7,112,348 | B2 * | 9/2006 | Mandai | B05C 11/1039 118/410 |
| 7,867,559 | B2 * | 1/2011 | Taniguchi | G03F 7/162 438/782 |
| 9,327,299 | B2 * | 5/2016 | Asikkala | B05C 5/0204 |
| 10,005,094 | B2 * | 6/2018 | Love, III | B05B 14/00 |
| 10,875,036 | B2 * | 12/2020 | Shimamura | C03C 17/32 |
| 11,318,493 | B2 * | 5/2022 | Buck, Jr. | B05C 5/025 |
| 2011/0014385 | A1 * | 1/2011 | Ahonen | C23C 26/00 118/66 |
| 2012/0258251 | A1 * | 10/2012 | Asikkala | B05B 7/0075 427/421.1 |
| 2016/0145741 | A1 * | 5/2016 | Miki Yoshida | C23C 16/4557 239/132 |
| 2018/0326436 | A1 * | 11/2018 | Li | B05C 9/14 |
| 2019/0210060 | A1 * | 7/2019 | Li | B05B 7/0012 |

* cited by examiner

EDGE-COATING A PANEL WITH A COATING MEDIUM

CROSS-REFERENCE TO RELATED APPLICATIONS

This application is a National Phase of International Application No. PCT/EP2021/057577, filed on Mar. 24, 2021, which claims the benefit of European Patent Application No. 20165261.7, filed on Mar. 24, 2020. The entire disclosures of the above applications are incorporated herein by reference.

FIELD

The disclosure relates to a coating device for a coating system for edge-coating a panel with a coating medium.

Also, the present disclosure relates to a coating system for edge-coating a panel with a coating medium.

BACKGROUND

This section provides background information related to the present disclosure which is not necessarily prior art.

A coating system for vacuum edge-coating of flat workpieces is known, for example, from laid-open document DE 4021174 A1. The flat workpieces are moved by conveyors and guided through edge-coating chambers, wherein several edge-coating chambers are arranged as required at the conveyors at any distance from a single base machine, wherein the base machine is subdivided into separate individual devices which can be arranged in any position relative to each other below the transport plane of the conveyors, and wherein automatic color change, automatic cleaning, un-interrupted filter changes or cleaning and emergency safety are realized by means of valves, controllers, and regulators.

Generally known up to now are coating systems, in which a coating medium is pumped into a pressure vessel. The medium is then conveyed by the pressure of the pressure vessel toward a coating head for coating. Here, the line for conveying the medium must first be vented. The medium is then pressed against the nozzle of the coating head via a ball valve at a constant pressure. Subsequently, the medium must be sucked off with a constant negative pressure applied to the coating head. In this way, a medium stream is created at the nozzle of the coating head. In such a system, the regulation of the quantity of the coating medium is effected manually and complicatedly adjustable.

SUMMARY

This section provides a general summary of the disclosure, and is not a comprehensive disclosure of its full scope or all of its features.

Based on this situation, it is an object of the present disclosure to enable an improved coating of panels. In particular, it is intended to reduce an expense in the coating process, while at the same time a quality of the coating is to be improved.

The object of the disclosure is achieved by the features of the independ-ent main claims. Advantageous embodiments are provided in the subclaims. If technically possible, the teachings of the subclaims can be combined as desired with the teachings of the main claims and subclaims.

Accordingly, the object is achieved by a coating device for edge-coating a panel with a coating medium. The device comprises: at least one medium line for guiding a coating medium, comprising an inlet and an outlet, wherein the medium line comprises a recess for introducing a panel into a coating medium stream, and wherein the medium line and the recess are designed such that the coating medium can be applied to the edge of the panel by means of suction in the medium flow direction.

The object is also achieved by a coating system for edge-coating a panel with a coating medium. The system comprises: a medium line system for guiding a coating medium, a pump system connected to the medium line system for conveying the coating medium, and at least one coating device according to the disclosure or according to at least one of the modified embodiments of the disclosure connected to the medium line system.

The coating system may employ one or more coating devices. For example, the use of two spaced apart coating devices in the coating system may be advantageous, wherein the coating devices may be spaced apart from each other in a conveyor system of the panel. The coating devices can, for example, be arranged in the conveyor system in such a way that the panel is first coated at its edge via a first coating device and then the panel is coated again with a further layer applied on the first layer at a second coating device.

Also disclosed is a coating method for edge-coating a panel with a coating medium. The method comprises the following method steps:

Introducing an edge of the panel into a coating medium stream via a recess of a coating device according to the disclosure or according to at least one of the modified embodiments of the disclosure.

Conveying the coating medium to the inlet of the coating device by means of a pump arranged upstream of an inlet of the coating device in the medium flow direction. The pump is designed according to at least one of the modified embodiments of the disclosure.

Conveying a coating medium within the coating device by means of a vacuum device arranged downstream of an outlet of the coating device in the medium flow direction. The vacuum device is designed according to at least one of the modified embodiments of the disclosure.

The disclosed method may comprise method steps corresponding to features of the coating system according to the disclosure or according to at least one of the modified embodiments of the disclosure.

The steps of the method are carried out in a sequence corresponding to the medium flow direction. It is preferred that the sequence of method steps can be varied, unless technically required in an explicit sequence. However, the above-described sequence of method steps is particularly preferred.

In the following, aspects of the claimed subject matter of the disclosure are explained and further below preferred modified embodiments of the disclosure are described. Explanations, in particular concerning advantages and definitions of features, are basically descriptive and preferred, but not limiting examples. Where an explanation is limiting, this is explicitly mentioned. If ranges of values are mentioned, these include the values mentioned.

Thus, one aspect of the present disclosure is to suck the coating medium through the coating device toward the base machine. This can advantageously reduce a complicated structure of the coating system as well as improve the quality of the coating on the panel.

In other words, by sucking through the medium at the coating device by use of vacuum, a great advantage is achieved in that the coating is homogeneous. At the device itself it is advantageously achieved that the medium can dry only slightly and that only slight turbulences occur, i.e. a medium-friendly and energy efficient coating is obtained. Moreover, the device is not very susceptible to dust and dirt, which is important, for example, in connection with a coating in a double-end profiler. Furthermore, the device significantly reduces or prevents sticking and contamination of conveyor belt-chain plate cams in the case of lacquers, so that time-consuming cleaning and maintenance can be significantly reduced or avoided.

With the simpler design, moreover, less susceptibility to failure is achieved. There is also less effort required for maintenance and cleaning. The simple design of the coating device without a nozzle is less prone to clogging. This, too, advantageously enables easy cleaning and maintenance. Furthermore, the coating device can be made more compact. For example, a coating head width with receptacle in a range of 15 cm to 20 cm can be avoided. Replacement and also upgrading of existing equipment is thus very easy.

Finally, the coating device can already be advantageous in that the entire coating system can be designed to be more space-saving. Also smaller line cross-sections than 50 mm to 60 mm in the area of the conveying circuit, in which vacuum is applied, can be selected, so that less drying of the coating medium occurs in the lines. This also allows the production of smaller charges without major rejects. Furthermore, there is an independence from a low-pulsation conveying technique, which is complicated and prone to errors. Furthermore, less attention has to be paid to maintain a constant pressure in the conveying circuit of the coating system. Moreover, many sensors can be dispensed with.

The vacuum device is preferably a side channel compressor. The preferred side channel compressor is a special type of compressor. It is used to compress or suck off air or other gases. Exemplary and non-limiting, a channel is mounted laterally from an impeller around almost its entire circumference. The gas can flow from the regions of the impeller separated by the blades to the channel and back again. Air is sucked in by a rapidly rotating impeller and is subsequently forced outward by a centrifugal force, whereby a compression is achieved. The air then flows back inwards via the side channel and is again accelerated between two further blades and com-pressed outwards. These multiple compressions enable to generate higher differential pressures compared to a fan. However, similar systems to a side channel compressor can also be designed as a vacuum device.

According to a modified embodiment of the disclosure, it is provided that the panel is a conveyed panel. The conveying direction of the panel can be arbitrary. For example, the panel may be a wooden plank. The conveying speed is adapted, for example, to the properties of a coating system, the characteristics of the coating medium and the speed of the medium stream.

According to a modified embodiment of the disclosure, it is provided that the medium line and the recess are configured such that at a medium pressure at the recess in a range from $3.5\times10^3$ Pa to $5.5\times10^3$ Pa, preferably at a medium pressure of $5\times10^3$ Pa, the coating medium can be applied to the edge of the panel. It has been found here that a particularly homogeneous coating of the panel is enabled. For this purpose, it is preferred that the coating medium is conveyed into the inlet of the coating device with an inlet pressure of $10^4$ Pa to $2\times10^4$ Pa. Such a low supply pressure reduces the risk that the coating medium unintentionally reaches the panel to be coated by suction in a coating manner. Nevertheless, this advantageous supply pressure is sufficient to convey the coating medium through the coating device by means of suction in such a way that a panel can be coated in a desired manner.

In other words, $3.5\times10^3$ Pascal correspond to 35 millibars. $5.5\times10^3$ Pascal correspond to 55 millibars. $5\times10^3$ Pascal correspond to 50 millibars. $10^4$ Pascal correspond to 0.1 bar. $2\times10^4$ pascals correspond to 0.2 bar.

According to a modified embodiment of the disclosure, it is provided that the recess and a medium line cross-section have an aspect ratio relative to one another and the medium line extends such that the coating medium can be applied to the edge of the panel due to a suction in the medium flow direction, in particular that the coating medium can be applied to the edge of the panel at a medium pressure in a range from $3.5\times10^3$ Pa to $5.5\times10^3$ Pa, preferably at a medium pressure of $5\times10^3$ Pa. These are further features that advantageously enable a particularly homogeneous coating.

According to a modified embodiment of the disclosure, it is provided that the recess is arranged at an outer bend of a curved or bent medium line section. This enables easy conveying of the panel past the recess of the coating device forming an opening, and at the same time advantageously enables a controlled application of coating medium onto the panel.

According to a modified embodiment of the disclosure, it is provided that the arcuate or bent medium line section has an acute inner angle, wherein an inlet piece extending from the inlet to the recess extends vertically in the state, in which the medium line is connected via the inlet. This advantageously reduces leakage of the coating medium from the coating device.

According to a modified embodiment of the disclosure, it is provided that the medium line is configured U-shaped with two legs, wherein in particular the inlet piece is a first leg and an outlet piece extending in the medium flow direction from the recess to the outlet is a second leg. Such a U-shaped configuration, in which an inflow takes place, for example, vertically or at least in a height ascending up to the recess, advantageously enables a good control of the medium stream and the pressure. At the same time, a flow of the coating medium in the medium flow direction is particularly advantageously achieved by this design. Moreover, an installation of a coating device configured in this way is simpler in a system for coating. In other words, due to the shape of the coating device, which can be combined with a higher mounting position relative to other components of the coating system, the coating medium can easily flow back into the base machine. In this regard, a similar operation to that of an over-flow is provided.

According to a modified embodiment of the disclosure, it is provided that an edge profile of the recess is designed to be adapted in a form-fitting manner to the edge of the panel, wherein in particular the edge profile of the recess is designed as a counter profile to a profile of the edge of the panel. This advantageously enables a more uniform coating of the panel, while at the same time a leakage of the medium from the recess can be reduced or prevented.

According to a modified embodiment of the disclosure, it is provided that two medium lines are provided for guiding the coating medium. This may be advantageous for coating larger areas of the panel simultaneously, while keeping a line cross-section smaller in order to thus provide a more controlled medium stream.

According to a modified embodiment of the disclosure, it is provided that the pumping system comprises a vacuum device downstream of the outlet in the medium flow direction, wherein the vacuum device and in particular a medium line cross-section of the medium line system, is designed to generate a negative pressure, i.e. suction, at the outlet. The aforementioned feature combined with the preferred coating device has advantages for the installation at a profiler, i.e. a conveyor belt chain: In the coating device, the medium is pressed almost pressure-free at the bottom and then sucked through by the vacuum. This makes the system splutter-free, i.e. no coating medium can splutter out from the recess. The prevention of coating medium spluttering out can be guaranteed even if the vacuum fails due to a fault. By sucking through the medium at the coating device with vacuum, one also has the advantage that the coating is homogeneous. Furthermore, there is no dependence on a low-pulsation conveying technique, which is complicated and error-prone.

According to a modified embodiment of the disclosure, it is provided that between the vacuum device and the outlet in the medium flow direction a separator system is interconnected, wherein the separator system is designed to separate gas supplied to the vacuum device from the coating medium. The separator system improves a quality of the coating medium in the conveying circuit of the coating system.

According to a modified embodiment of the disclosure, it is provided that the separator system comprises a screen system for separatively filtering the coating medium from the gas. This is a simple and inexpensive possibility to separate the coating medium from the gas. Moreover, a screen system is easier to clean and maintain.

According to a modified embodiment of the disclosure, it is provided that the separator system comprises a lid for making the separator system accessible. For example, the lid may be made of acrylic glass. Such a lid allows the system to be inspected during operation, while at the same time allowing the separator system to be cleaned easily.

According to a modified embodiment of the disclosure, it is provided that in the medium flow direction between the separator system and the inlet a pump of the pumping system is interconnected, wherein the pump is configured to convey the coating medium to the inlet in a meterable manner. The pump enables a careful conveying for the medium to be coated. Moreover, very small quantities can be conveyed steplessly. Both are advantages of the pump, which allow that the medium does not foam and that the coating process provides a homogeneous coating of good quality. Moreover, maintenance and cleaning of the entire system is improved or facilitated.

According to a modified embodiment of the disclosure, it is provided that the pump is a shear force-free pump. Preferably and non-limiting, the pump is a peristaltic pump, wherein the peristaltic pump in particular comprises a hose with chlorosulfonated polyethylene (CSM), wherein in particular the hose is made of CSM. A peristaltic pump is one possible exemplary embodiment of a shear force-free pump, in which the advantages occur which were described in connection with the previously described embodiment. In the case of the hose made of CSM, or comprising CSM, it has been found advantageously that a particularly high resistance to the coating medium is achieved. A shear force-free pump has the advantage that the coating medium does not foam and thus the coating quality is increased.

In principle, however, other pumps are also possible, for example a double diaphragm pump or similarly acting pumps.

According to a modified embodiment of the disclosure, it is provided that the pump, and in particular a medium line cross-section of the medium line system, is designed to convey the coating medium in such a way that the inlet is supplied with the coating medium with a supply pressure greater than/equal to the medium pressure at the recess, preferably with a supply pressure greater than/equal to $3.5\times10^3$ Pa, particularly preferably with a supply pressure of $10^4$ Pa to $2\times10^4$ Pa. The volume flow of the coating medium is adjusted, for example by the line dimensioning, in such a way that the coating medium is sucked off in the effective area of the recess faster than it is supplied in the effective area of the inlet, in order to avoid a too fast introduction of the coating medium into the coating device. The dimensioning of the medium line cross-sections can be made taking into account the aspect that the coating medium foams less with smaller medium line cross-sections. Also, a more careful conveyance is preferred. Moreover, smaller quantities can be conveyed in the system, for example for smaller charges. Furthermore, there is the advantage that the coating medium is pressed into the coating device almost without pressure. This in turn enables a better control of a medium stream in the area of the recess due to the generated suction.

According to a modified embodiment of the disclosure, it is provided that in the medium flow direction between the separator system, in particular between the pump and the inlet, a heater is interconnected, wherein the heater is configured to heat the coating medium to a temperature in a range from 30° C. to 45° C. In this temperature range a foam development of the coating medium is substantially reduced or avoided, whereby a function of the coating system is clearly improved and failures can be avoided. A further advantage is that, irrespective of the room temperature, coating can always be carried out homogeneously with a constant application quantity.

DRAWINGS

The drawings described herein are for illustrative purposes only of selected embodiments and not all possible implementations, and are not intended to limit the scope of the present disclosure.

In the following, the disclosure is explained in more detail with reference to the accompanying drawings based on preferred exemplary embodiments. The term Figure is abbreviated in the drawings as Fig.; In the drawings.

Corresponding reference numerals indicate corresponding parts throughout the several views of the drawings.

DETAILED DESCRIPTION

Example embodiments will now be described more fully with reference to the accompanying drawings.

The exemplary embodiments described are merely examples that can be modified and/or supplemented in various ways within the scope of the claims. Each feature described for a particular exemplary embodiment may be used independently or in combination with other features in any other exemplary embodiment. Any feature described for an exemplary embodiment of a particular claim category may also be used in a corresponding manner in an exemplary embodiment of another claim category.

Figure 1:
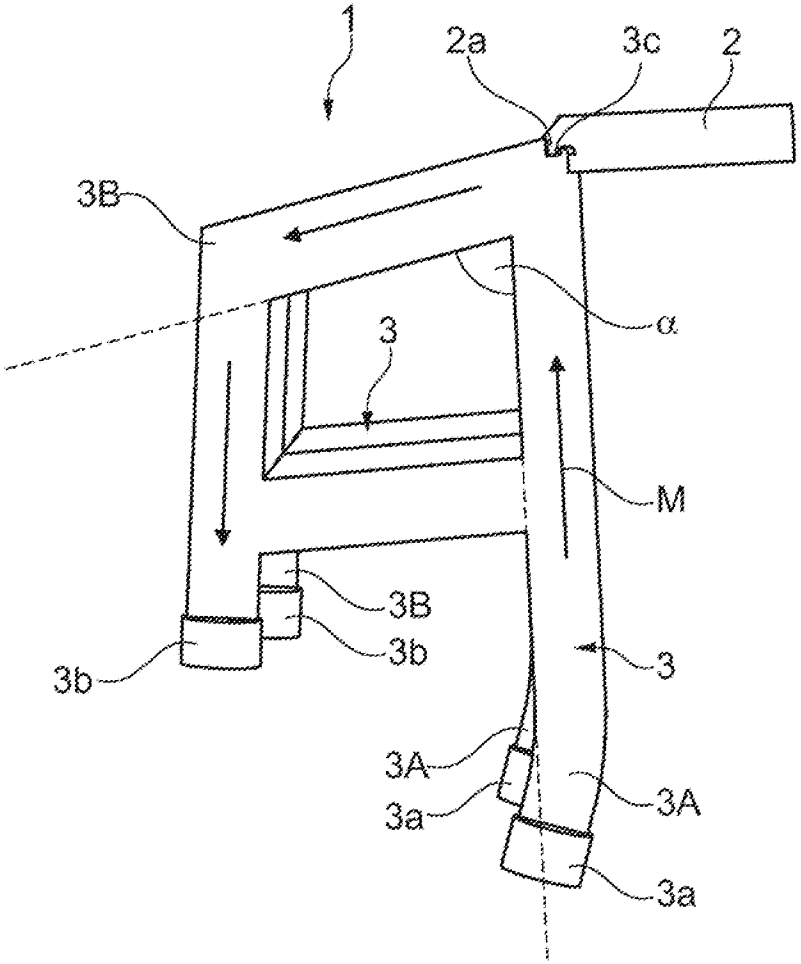
FIG. 1 is a schematic view of the coating device according to a preferred exemplary embodiment of the disclosure.

FIG. 1 shows a schematic view of the coating device 1 according to a preferred exemplary embodiment of the disclosure. The coating device 1 is adapted for edge-coating a panel 2 with a coating medium B. The panel 2 is conveyed in a conveying direction during coating (see FIG. 3). The conveying direction and speed can be adapted according to a speed of the medium stream of the coating medium B.

The coating device 1 according to the exemplary embodiment comprises: two medium lines 3, each configured to guide the coating medium B, and each provided with an inlet 3*a* and an outlet 3*b*. Inlet 3*a* and outlet 3*b* are connected to a coating medium circuit of a coating system 100 (see FIG. 3). The coating medium B flows through each of the medium lines 3 in a medium flow direction M. The medium lines 3 can be connected to the coating medium circuit individually or together, for example via a Y-shaped connecting piece. The coating device 1 can have an overall width of 20 mm, for example. The line diameter in the area of the outlet 3*b* or the outlet piece 3B can be 19 mm at the medium lines 3.

Each of the medium lines 3 has a recess 3*c* for introducing the panel 2 into a coating medium stream. According to the exemplary embodiment, one edge of the panel 2 is introduced into the coating medium stream of the coating medium B. The coating medium B flows past the edge of the panel 2 and wets a surface of the panel 2 in the region of this edge.

The medium line 3 and the recess 3*c* are configured such that the coating medium B can be applied onto the edge 2*a* of the panel 2 by means of a suction in the medium flow direction M. The edge 2*a* comprises the edge described above. In particular, an edge profile of the recess 3*c* is configured to be adapted in a form-fitting manner to the edge 2*a* of the panel 2. In FIG. 1, it can be seen that the edge profile of the recess is configured as a counter profile to a profile of the edge 2*a* of the panel 2. The aforementioned suction in the medium flow direction M advantageously enables a uniform medium flow and a bubble-free conveying and coating of the panel 2.

The medium line 3 and the recess 3*c* are designed in such a way that a medium pressure acting as suction is generated at the recess 3*c* in a range from $3.5\times10^3$ Pa to $5.5\times10^3$ Pa for the coating medium B at the edge 2*a* of the panel 2. A medium pressure of $5\times10^3$ Pa is particularly preferred. In this case, an aspect ratio of the recess 2*a* and of a cross-section of the medium line and the constructional design of the medium line 3 contribute to the desired medium pressure.

For this purpose, it is preferred that the coating medium B is conveyed into the inlet 3*a* of the coating device 1 with an inlet pressure of $10^4$ Pa to $2\times10^4$ Pa. Such a low supply pressure reduces the risk that the coating medium B unintentionally reaches the panel 2 to be coated by suction in a coating manner. Nevertheless, this advantageous supply pressure is sufficient to allow the coating medium B to be conveyed through the coating device 1 by means of suction in such a way that a panel 2 can be coated in the desired manner.

The recess 3*c* is arranged at an outer bend of a bent medium line section. The bent medium line section has an acute inner angle (alpha), wherein the inner angle (alpha) is enclosed by an outlet piece 3B and an inlet piece 3A. The inlet piece 3A, which extends from the inlet 3*a* to the recess 3*c*, extends vertically in the state in which the medium pipe 3 is connected via the inlet 3*a*. The inlet 3*a* is then connected to the coating system 100 of FIG. 3. The medium line 3 according to the exemplary embodiment is configured U-shaped with two legs, wherein the inlet piece 3A is a first leg and the outlet piece 3B extending in the medium flow direction M from the recess 3*c* to the inlet 3*b* is a second leg.

Figure 2:
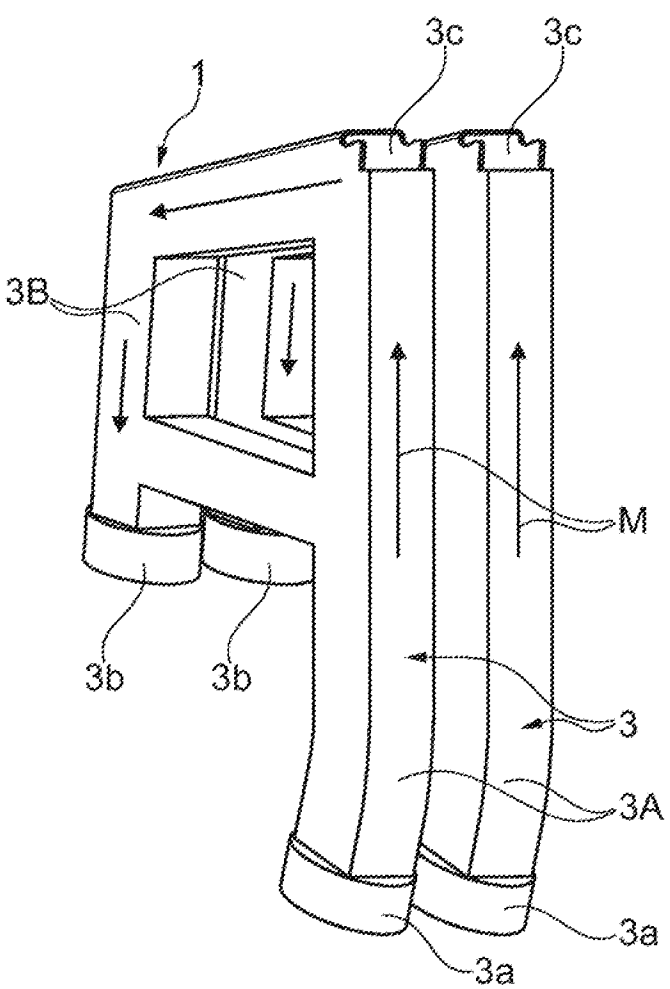
FIG. 2 is another schematic view of the coating device according to the preferred exemplary embodiment of the disclosure.

FIG. 2 shows another schematic view of the coating device 1 according to the preferred exemplary embodiment of the disclosure. Here, the two medium lines 3 can be viewed from a different perspective.

Figure 3:
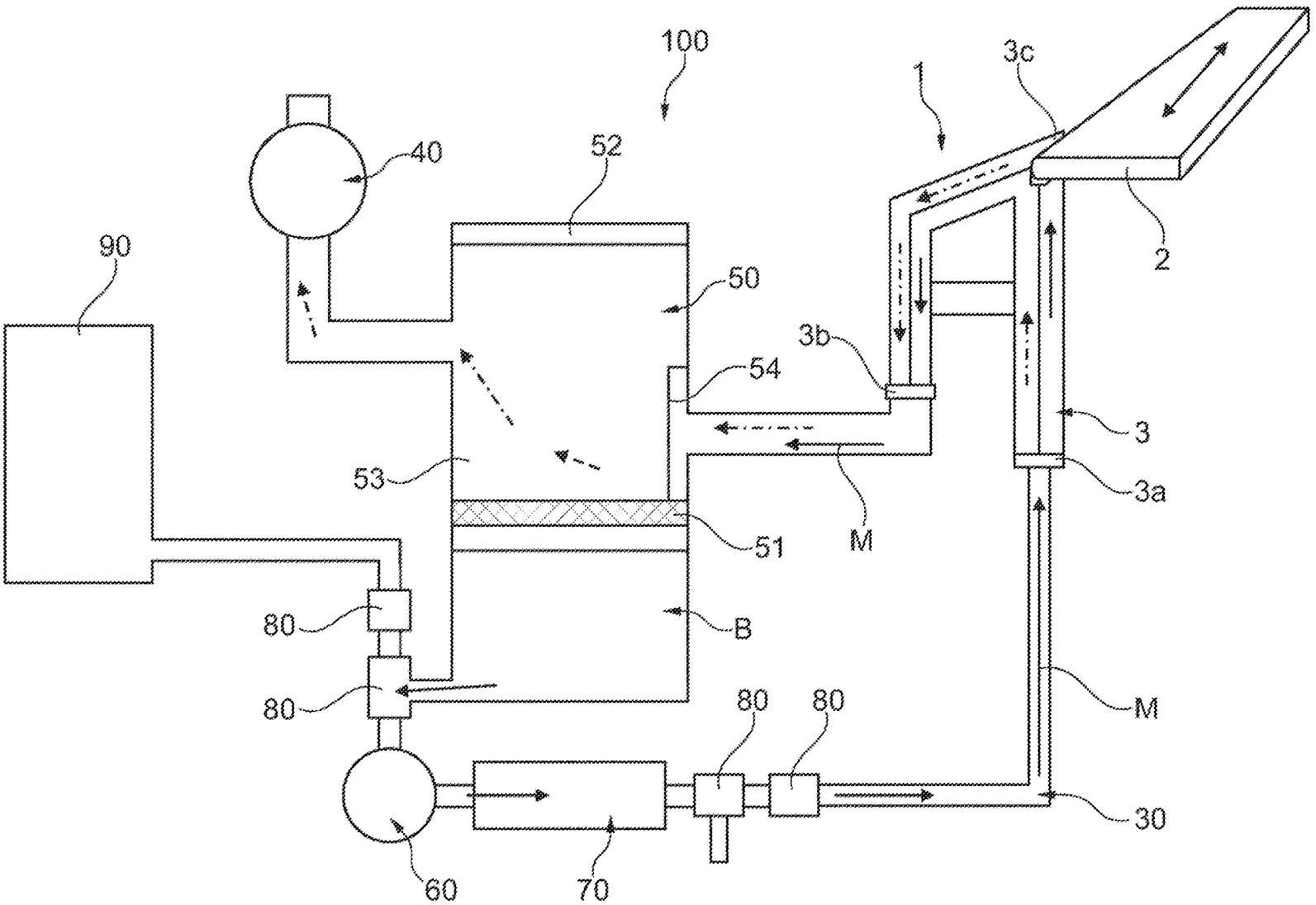
FIG. 3 is a schematic view of a coating system according to a preferred exemplary embodiment of the disclosure.

FIG. 3 shows a schematic view of a coating system 100 according to a preferred exemplary embodiment of the disclosure.

The coating system 100 comprises: a medium line system 30 for guiding the coating medium B; a pump system connected to the medium line system 30 for conveying the coating medium B; and a coating device 1 connected to the medium line system 30 as previously described. The medium line system 30 includes a plurality of valves 80. Moreover, a coating medium container 90 filled with the coating medium B is part of the medium line system 30.

The pump system comprises a vacuum device 40 downstream of the outlet in the medium flow direction M, wherein the vacuum device 40 and a medium line cross-section of the medium line system 30 are configured to generate a negative pressure at the outlet 3*b*, i.e. to generate the suction behind the recess 3*c*.

A separator system 50 is interconnected in the medium flow direction M between the vacuum device 40 and the outlet 3*b*. The separator system 50 is configured to separate gas supplied to the vacuum device 40 from the coating medium B. The separator system 50 comprises a screen system 51 for separatively filtering the coating medium B from the gas. The separator system 50 further comprises a lid 52 made of acrylic glass, which is part of a housing 53 of the separator system 50. The lid 52 can be opened in order to clean the separator system 50 or to view a production process in the separator system 50. Further, the separator system 50 comprises a guide wall 54 configured to guide the gas-coating medium mixture to the screen system 51.

In the medium flow direction M between the separator system 50 and the inlet 3*a* a pump 60 of the pump system is interconnected, which is configured exemplarily as an shear force-free pump 60, wherein the shear force-free pump 60 is configured for meterable conveyance of the coating medium B to the inlet 3*a*. The shear force-free pump 60 is a peristaltic pump, wherein the peristaltic pump comprises a hose comprising chlorosulfonated polyethylene (CSM). In principle, other pumps are also possible.

The shear force-free pump 60 and a medium line cross-section of the medium line system 30 are configured to convey the coating medium B such that the inlet 3*a* is supplied with the coating medium B with an inlet pressure greater than/equal to the medium pressure at the recess 3*c*, for example with an inlet pressure greater than $10^4$ Pa.

A heater 70 is interconnected in the medium flow direction M between the separator system 50, i.e. between the shear force-free pump 60, and the inlet 3*a*. The heater 70 is configured to heat the coating medium B to a temperature in a range from 30° C. to 45° C.

Figure 4:
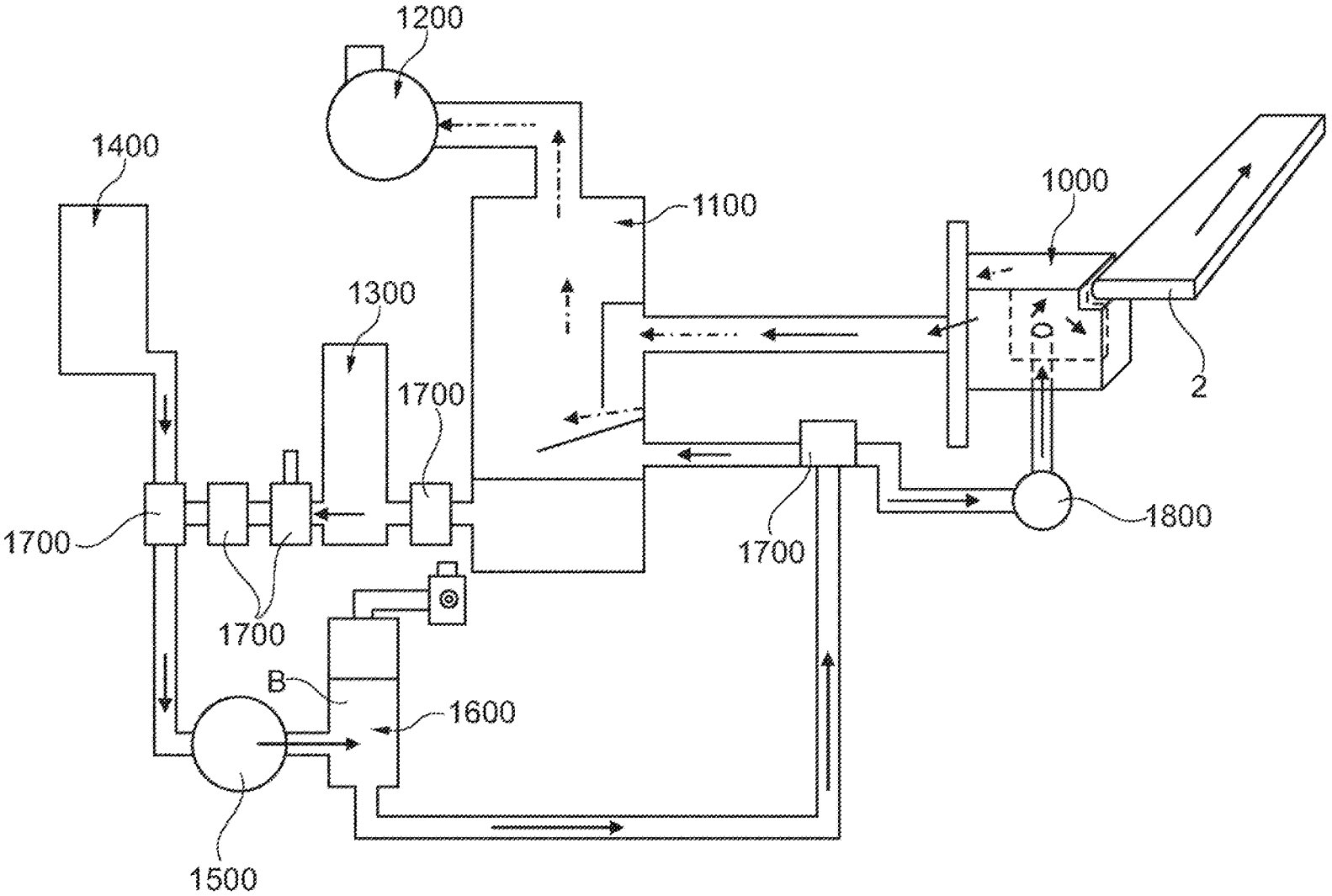
FIG. 4 is a schematic view of a coating system according to the prior art.

FIG. 4 shows a schematic view of a coating system according to the prior art. The coating system comprises in its medium line system a medium container 1400, which feeds the circuit with the medium for coating a panel 2. A plurality of valves 1700 are provided as part of the medium line system, wherein valves having particular functions are described in more detail below. In the coating system according to the prior art, the medium is supplied from a base machine 1100 by use of a vacuum device 1200 configured as a double diaphragm pump through a filter designed as a medium filter 1300. Subsequently, the medium is pumped by means of a pump 1500 into a pressure vessel, which is a pulsation damper 1600. The medium is then conveyed by the pressure of the pressure vessel to a coating head 1000 for coating. In this case, the line for conveying the medium must first be vented. Subsequently, the medium is pressed via a ball valve 1800, which is configured as a metering valve, at a constant pressure against the nozzle at the coating head 1000. Subsequently, the medium must be sucked off with a constant negative pressure applied to the coating head 1000. In this way, a medium flow is created at the nozzle of the coating head 1000. The coating system is then operated in a stationary state. Here, the medium is pumped in the circuit of the coating system. Here the base machine 1100 separates the medium for coating the panel 2 and a gas kept at negative pressure, which is required for coating and for the cycle. If now a panel 2 passes the coating head 1000, in a coating area of the coating head 1000, i.e., the nozzle, the vacuum can no longer suck off the medium and the panel 2 is coated, i.e., lacquered. The excess medium is sucked off and is returned into the circuit. Here, the quantity regulation is effected manually and is adjustable in a complicated way. The medium pressure in the coating head 1000 is between $15\times10^4$ Pa and $20\times10^4$ Pa in order to ensure that the panel 2 is sprayed or coated with the coating medium without interruption. Depending on foam formation due to spraying, an uneven coating is applied to the panel 2.

Figure 5:
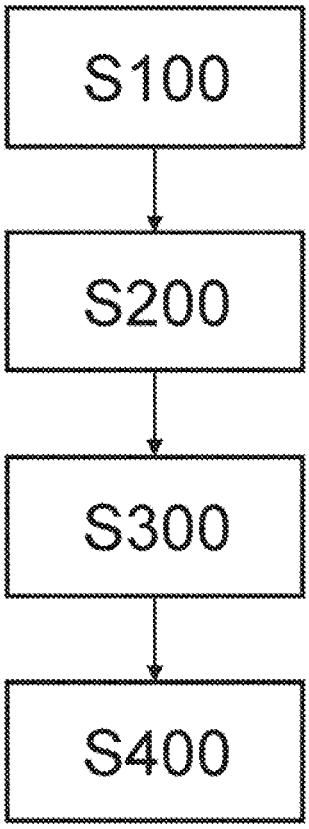
FIG. 5 is a flow chart of an exemplary coating method.

FIG. 5 shows a flow chart of an exemplary coating method.

According to a method step with the reference number "S100", an edge 2*a* of the panel 2 is introduced into a coating medium stream via a recess 3*c* of the coating device 1.

According to a method step with the reference number "S200", the coating medium B is conveyed in the medium flow direction M to the inlet 3*a* of the coating device 1 by means of a shear force-free pump 60 arranged upstream of an inlet of the coating device 1. In this case, the medium is pumped out of the separator system 50 by means of a peristaltic pump and is pumped to the coating device 1 through the heater 70, which is configured as a continuous flow heater. In this case, the coating medium B is pumped almost without pressure to the inlet 3*a* of the coating device 1.

According to a method step with the reference number "S300", the coating medium B is conveyed in the medium flow direction M within the coating device 1 by means of a vacuum device 40 arranged downstream of an outlet of the coating device 1. In other words, the coating medium B is sucked through the coating device 1 to the separator system 50 while being subjected to a negative pressure.

Subsequently, according to a step with the reference number "S400", the separator system 50 separates the coating medium B from a gas subjected to a negative pressure. The medium can be gently filtered by the screen system configured as a screen basket, and the medium can be conveyed in the circuit of the coating system 100.

During operation of the coating system 100, an air-medium mixture is generated at the recess 3*c* of the coating device 1, which is designed with a counter profile to the coating area of the panel 2. If now a panel 2 is moved past the coating device 1—irrespective of a travel direction—the panel 2 is coated in its coating area by the incoming flow of the air-medium mixture, i.e. lacquered. The excess medium is sucked off and returns into the circuit of the coating system 100. Here, the quantity regulation of the coating medium is fully automated.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A coating system for edge coating a panel with a coating medium, wherein the coating system comprises:
- a medium line system for guiding the coating medium;
- a pump system connected to the medium line system for conveying the coating medium; and
- at least one coating device connected to the medium line system, wherein the coating device comprises:
- at least one medium line for guiding the coating medium, comprising an inlet and an outlet,
- wherein the medium line comprises a recess for introducing a panel into a coating medium stream, and
- wherein the medium line and the recess are designed in such a way that the coating medium can be applied onto an edge of the panel by means of suction in a medium flow direction,
- wherein the pump system comprises a vacuum device arranged downstream of the outlet in the medium flow direction,
- wherein the vacuum device is configured to generate a negative pressure at the outlet.

2. The coating system according to claim 1,
- wherein a medium line cross-section of the medium line system is also configured to generate a negative pressure at the outlet.

3. The coating system according to claim 2, wherein a separator system is interconnected in the medium flow direction between the vacuum device and the outlet,
- wherein the separator system is configured to separate gas supplied from the vacuum device from the coating medium,
- wherein the separator system comprises a screen system for separatingly filtering the coating medium from the gas,
- wherein the separator system comprises a lid for making the separator system accessible.

4. The coating system according to claim 3,
- wherein a pump of the pump system is interconnected in the medium flow direction between the separator system and the inlet,
- wherein the pump is configured for meterable conveyance of the coating medium up to the inlet.

5. The coating system according to claim 4,
- wherein the pump is a shear force-free peristaltic pump,
- wherein the peristaltic pump comprises a hose comprising chlorosulfonated polyethylene (CSM).

6. The coating system according to claim 4,
- wherein the pump, and a medium line cross-section of the medium line system, is configured to convey the coating medium in such a way that the inlet is fed with the coating medium with a supply pressure greater than or equal to a coating medium pressure at the recess (3*c*), or with the supply pressure greater than or equal to $3.5\times10^3$ Pa, or with the supply pressure of $10^4$ Pa to $2\times10^4$ Pa.

7. The coating system according to claim 3, wherein a heater is interconnected in the medium flow direction between the separator system or the pump, and the inlet, wherein the heater is configured for heating the coating medium to a temperature in a range from 30° C. to 45° C.

8. The coating system according to claim 1, wherein the panel is a conveyed panel.

9. The coating system according to claim 1, wherein the medium line and the recess are configured in such a way that the coating medium can be applied to the edge of the panel at the medium pressure at the recess in a range from $3.5\times10^3$ Pa to $5.5\times10^3$ Pa, or at the medium pressure of $5\times10^3$ Pa.

10. The coating system according to claim 1, wherein the recess and a medium line cross-section have an aspect ratio relative to one another and the medium line extends in such a way that the coating medium can be applied onto the edge of the panel by means of suction in the medium flow direction, or that the coating medium can be applied onto the edge of the panel at the medium pressure in a range from $3.5\times10^3$ Pa to $5.5\times10^3$ Pa, or at the medium pressure of $5\times10^3$ Pa.

11. The coating system according to claim 1, wherein the recess is arranged at an outer bend of an arc-shaped or bent medium line section, wherein the arc-shaped or bent medium line section has an acute inner angle, wherein an inlet piece, which extends from the inlet to the recess, extends vertically in a state in which the medium line is connected via the inlet.

12. The coating system according to claim 11, wherein the medium line is U-shaped with two legs, wherein the inlet piece is a first leg and an outlet piece extending in the medium flow direction from the recess to the outlet is a second leg.

13. The coating system according to claim 1, wherein an edge profile of the recess is configured to be adapted form-fittingly to the edge of the panel, and wherein the edge profile of the recess is configured as a counter profile to a profile of the edge of the panel.

14. The coating system according to claim 1, wherein two medium lines are provided for guiding the coating medium.

* * * * *